US005609524A

United States Patent [19]

Inoue

[11] Patent Number: 5,609,524

[45] Date of Patent: Mar. 11, 1997

[54] SLOT MACHINE

[75] Inventor: Haruo Inoue, Tokyo, Japan

[73] Assignee: Eagle Co., Ltd., Tokyo, Japan

[21] Appl. No.: 501,315

[22] Filed: Jul. 12, 1995

[30] Foreign Application Priority Data

Dec. 22, 1994 [JP] Japan ..... 6-320973

[51] Int. Cl.[6] ..... A63F 5/04

[52] U.S. Cl. ..... 463/20

[58] Field of Search ..... 463/20, 21; 273/143 R

[56] References Cited

U.S. PATENT DOCUMENTS 4,838,552 6/1989 Hagiwara ..... 463/20

4,874,173 10/1989 Kishishita ..... 273/143 R

FOREIGN PATENT DOCUMENTS 6-17442 5/1994 Japan .

*Primary Examiner*—William H. Grieb

*Attorney, Agent, or Firm*—Young & Thompson

[57] ABSTRACT

A slot machine is provided with a plurality of motors each arranged for rotating a respective one of a plurality of reels. A first drive device starts driving the motors in response to a start signal, and stops driving the motors in accordance with stop signals sequentially generated for respective ones of the motors. A second drive device is provided for driving a part of the motors when it is determined that there is at least an effective winning symbol combination, to rotate those ones of the reels which stop with symbols of the obtained winning symbol combination, again in a special fashion to make an appeal to the winner.

18 Claims, 5 Drawing Sheets

SLOT MACHINE

BACKGROUND OF THE INVENTION

1. Field of the Invention

The present invention relates to a slot machine which drives step motors to start and stop rotating reels, and more particularly to a slot machine capable of making an appeal to the player at having won a prize.

2. Background Art

In a conventional slot machine, a plurality of reels, for example, three to five reels are disposed in a horizontal row. These reels have various symbols arranged in different sequences around their peripheral surfaces. The reels are respectively coupled to drive shafts of step motors. After one or a couple of coins ( or tokens ) are inserted, the step motors start driving all the reels at the same time in response to an operation of a start lever. The step motors are individually stopped in response to stop signals. The stop signals are automatically and randomly generated in an auto-stop type slot machine, or are generated upon manual operation of at least a stop button in a manual-stop type slot machine. When the reels are stopped in this way, three symbols are displayed in each of display windows which are provided for the respective reels. Thus, as for three-reel type slot machine, nine symbols in total are displayed as a result of each game.

Ordinarily, in three-reel type slot machines, five, i.e. three horizontal and two diagonal winning lines are provided across the display windows such that three symbols appear on each winning line when the reels stop. Depending upon the number of tokens (or coins) inserted for a game, one or more of these winning lines are effectuated for the game: the more tokens make the more lines effective. If three symbols aligned in any of the effective winning lines constitute one of predetermined winning symbol combinations, a number of tokens are paid out according to the rank of prize assigned to the consequent winning symbol combination.

There are many prize ranks in slot machines. For example, when a given symbol, e.g. "Cherry" stops on the effective winning line, a couple of token are paid out as a prize of the lowest rank called a small hit. A middle hit is given when predetermined two or three kinds of symbols are aligned in the effective winning line, with payment of about five to fifteen tokens. In addition to these prize ranks, a big hit is provided as a prize of the highest rank. As an example of big hit, a jack pot is given when a symbol combination "7"- "7"- "7" is displayed in the effective winning line, awarding an enormous number of tokens. Another example of big hit, called bonus hit, allows the player to play a special or bonus game again at an especially high probability of winning. Accordingly, most players feel a great interest in the big hit.

To make the player feel greater satisfaction at having won the big hit in the interest of greater amusement for the player, many conventional slot machines are designed to show a special performance when the big hit is carried off. To get stronger appeal to the players, a variety of such triumphal performances have been developed. For example, in those slot machine which have luminescent elements on one or opposite ends of the winning lines to indicate the effective winning line or lines by lighting, all the luminescent elements start winking or lighting in different colors at the big hit.

Slot machines are also known which have lamps or the like mounted inside the reels to illuminate the reels in a winking fashion when the big hit is carried off.

Since the luminescent elements can have few winking patterns, the above-described known triumphal performance is too monotonous to have an appeal to the players. Using a lot of luminescent elements having different colors may give variety to the performance, but cannot sufficiently relieve the monotony. Rather, the increased number of luminescent elements and diffusion plates therefor as well as complicated wiring of these elements must raise the cost of the slot machine.

Indeed the slot machine having lamps inside the reels can make an attractive triumphal performances by designing colors and light-up patterns of the lamps appropriately. But this resolution also needs to incorporate the lamps and their drive circuit into the slot machine, so that not only the cost of the slot machine is raised, but also the scale of the slot machine must be increased to provide a room for the lamps.

Recently, a matrix-type slot machine has been suggested in U.S. patent Application Ser. No. 08/184,033 filed by the present applicant, which has a plurality of, e.g. nine reels arranged in a matrix. Because the nine-reel type slot machine has a lot of winning lines, i.e. three horizontal, three vertical and two diagonal winning lines, some inexperienced player may not easily recognize on which winning line the big hit combination appears, or what kind of hit or winning symbol combination is provided.

OBJECT OF THE INVENTION

In view of the foregoing, a prime object of the present invention is to provide a slot machine which can display an attractive triumphal performance when the player wins a prize, without the need for additional parts, additional space and additional cost for the triumphal performance. The prize may be the small hit or the middle hit, to say nothing of the big hit.

Another object of the present invention is to provide a matrix-type slot machine having a plurality of winning lines, which permits even inexperienced player easily to recognize which winning line displays a hit combination, or what kind of hit combination is displayed.

SUMMARY OF THE INVENTION

To achieve the above object, the present invention provides a plurality of motors each arranged for rotating a respective one of plurality of reels, a first drive device which starts driving the motors in response to a start signal, and stops driving the motors in accordance with stop signals sequentially generated for respective ones of the motors, and a second drive device for driving a part of the motors when it is determined that there is at least a winning symbol combination, to rotate those ones of the reels which stop with symbols of the obtained winning symbol combination, again in a special fashion.

The slot machine according to the present invention can make an appeal to the player at the occurrence of a hit (=a win) in a novel fashion that the reels displaying the hit or winning symbols are rotated in a special pattern. This is a unique triumphal performance which effectively increase the player's satisfaction without the need for any complicated mechanism or system.

Also, thanks to the triumphal rotation of the present invention, even an inexperienced player can be aware of the obtained hit combination at a glance in the matrix-type slot machine having a lot of winning lines.

BRIEF DESCRIPTION OF THE DRAWINGS

Other objects and advantages of the present invention will become apparent in the following detailed description of the preferred embodiments when read in connection with the accompanying drawings, wherein like reference numerals designates like or corresponding parts throughout the several views, and wherein.

DETAILED DESCRIPTION OF THE PREFERRED EMBODIMENTS

Figure 1:
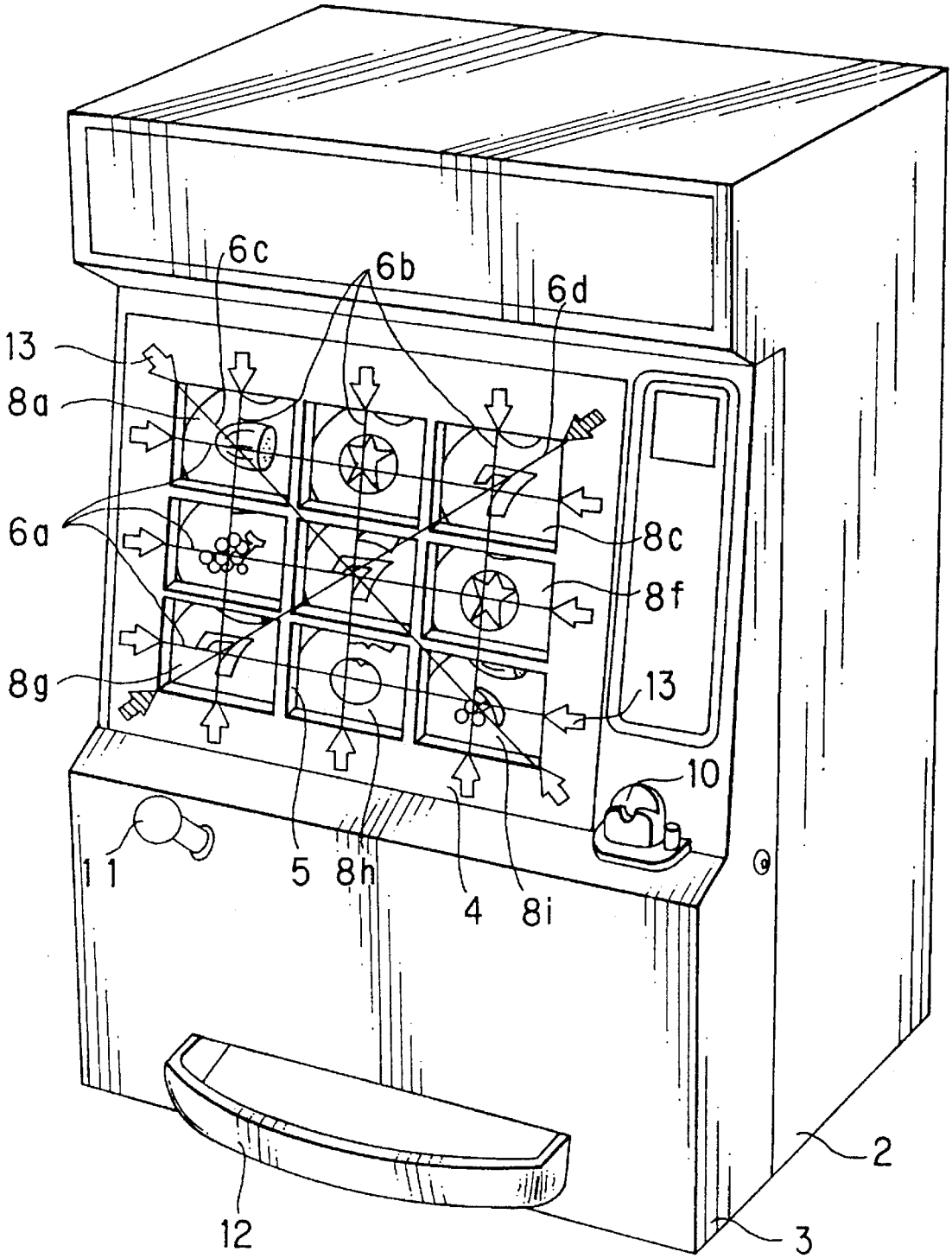
FIG. 1 is a perspective view of a slot machine according to a preferred embodiment of the invention.

FIG. 1 shows a nine-reel type slot machine embodying the present invention, which has a housing 2 with a front door 3 openably hinged on the front thereof. The front door 3 has a display panel 4 through which nine display windows 5 are formed in 3×3 matrix arrangement. In correspondence with the nine display windows 5, nine reels 8*a*, 8*b*, 8*c*, 8*d*, 8*e*, 8*f*, 8*g*, 8*h* and 8*i* are mounted in the housing 2, though the reference numbers 8*b* and 8*d* are omitted for clarity of the drawings. These reels 8*a* to 8*i* are respectively coupled to drive shafts of nine step motors 25*a* to 25*i* (see FIG. 3), to be rotatable about the drive shafts which extend in the same horizontal direction. Each of the reels 8*a* to 8*i* has a plurality of various symbols, such as "7", "Star" and "Cherry", affixed on an outer circumference thereof.

Figure 2:
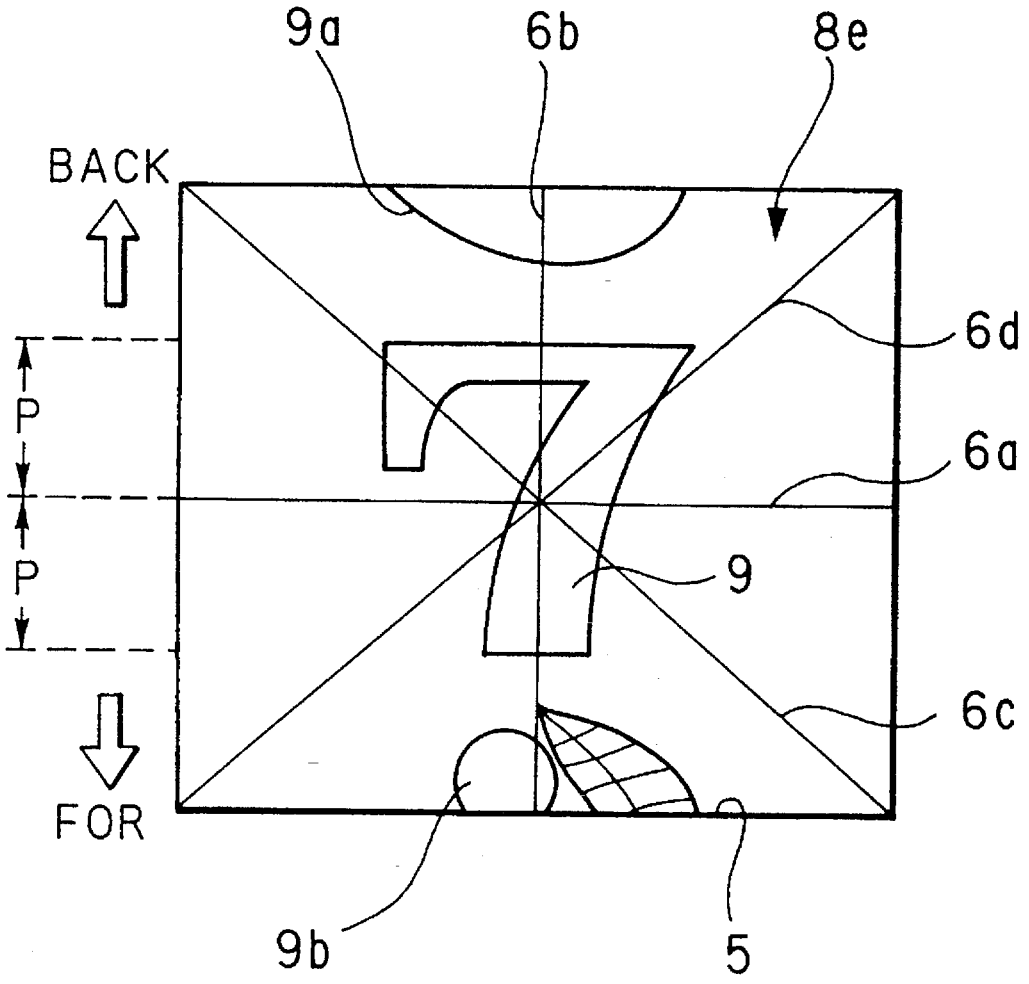
FIG. 2 is an enlarged view of a display window of the slot machine of FIG. 1, for explaining a triumphal rotation according to a preferred embodiment of the invention.

The reels 8*a* to 8*i* stop to display a whole symbol 9 in a center of each display window 5, while two adjacent symbols 9*a* and 9*b* are partly viewed through the display window 5, as shown for example with respect to the center reel 8*e* in FIG. 2. Thus, nine whole symbols 9 are viewed through the nine display windows 5 when all the reels 8*a* to 8*i* stop. There are three horizontal winning lines 6*a*, three vertical winning lines 6*b* and two diagonal winning lines 6*c* and 6*d* in front of the display windows 5 across the centers of the display windows 5.

The front door 3 is further provided with a slot 10, a start lever 11 and a tray 12. In this embodiment, one, two or three tokens (or coins) should be inserted in the slot 10 before starting a game by operating the start lever 11. When a token is inserted in the slot 10 for a game, the three horizontal winning lines 6a are effectuated for the game. When two tokens are inserted in the slot 10, the three vertical winning lines 6*b* as well as the three horizontal winning lines 6*a* are effectuated for the game. When three token are inserted in the slot 10, all of the eight winning lines 6*a* to 6*d* are made effective for the game. At each end of the winning lines 6*a* to 6*d*, an arrow mark 13 is provided on the display panel 4. Each time a token is inserted, those arrow marks 13 which are assigned to the effectuated winning lines are lighten up to allow to visually confirm the presently effective winning lines.

Thereafter, upon an operation of the start lever 11, the reels 8*a* to 8*i* simultaneously start rotating. In this embodiment, the reels 8*a* to 8*i* automatically stop in a manner as set forth below. When all the reels 8*a* to 8*i* stop, if any combination of three symbols on one of the effective winning lines constitutes one of predetermined hit combinations, a number of tokens are paid out in accordance with the rank of the displayed hit combination.

Figure 3:
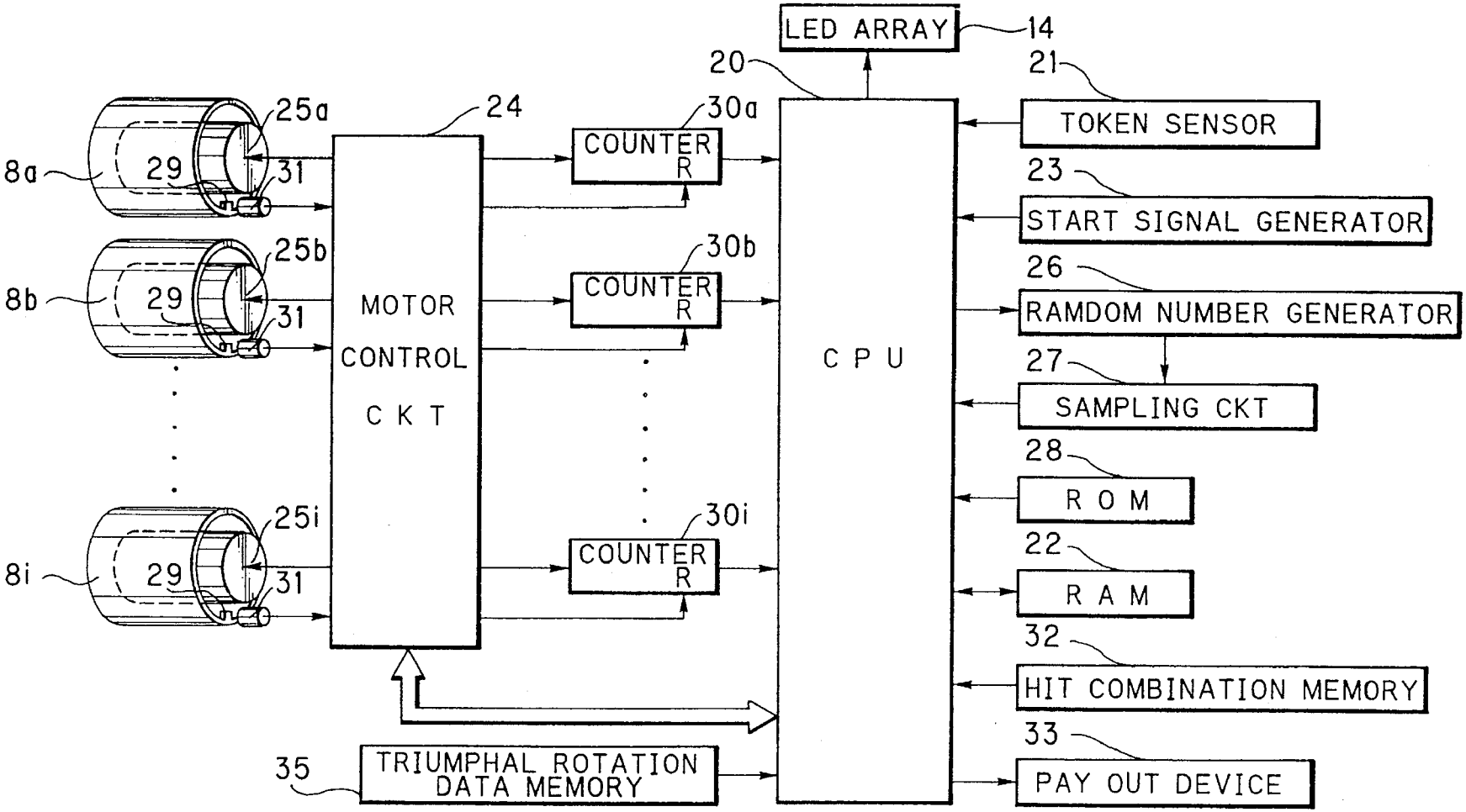
FIG. 3 is a functional block diagram of the slot machine.

FIG. 3 show the electric circuitry of the slot machine. A token sensor 21 outputs a detection signal to a CPU 20 each time a token is inserted in the slot 10. The CPU 20 controls an array of light emitting diodes (LEDs) 14 on and off, which are disposed behind the arrow marks 13 of the display panel 4. In response to the detection signal from the token sensor 21, corresponding ones of the LEDs 14 are turned on to indicate the effectuated winning lines. The CPU 20 also writes the number of inserted tokens in RAM 22.

A start signal generator 23 outputs a start signal to the CPU 20 when the start lever 11 is operated after at least a token is inserted. In response to the start signal, the CPU 20 causes a motor control circuit 24 to simultaneously supply drive pulses to the step motors 25*a* to 25*i* to start rotating the reels 8*a* to 8*i*. A random number generator 26 generates random numbers in a range from "1" to "9" in response to a command from the CPU 20 which is outputted upon the start signal. A sampling circuit 27 samples a random number at a time among the random numbers from the random number generator 29 after the reels 8*a* to 8*i* come to rotate at a constant speed. The sampling circuit 27 repeats sampling nine times per one game while the CPU 20 sequentially assigns the sampled random numbers to the reels 8*a* to 8*i* in one to one relationship. In accordance with the assigned random numbers, the motor control circuit 24 stops supplying the drive pulses to the step motors 25*a* to 25*i*. ROM 28 stores a sequence program for the CPU 20 to sequentially control the overall operation of the slot machine.

The numbers of the drive pulses supplied from the motor control circuit 24 to the step motors 25*a* to 25*i* are respectively counted by nine counters 30*a* to 30*i*, each of which is associated with one of the step motors 25*a* to 25*i*. Each of the counters 30*a* to 30*i* has a reset terminal connected to a photo-sensor 31. Each time the photo-sensor 31 detects a signal tab 29 which is formed on each of the reels 8*a* to 8*i* to indicate a reference position thereof, a signal is inputted though the reset terminal to reset the corresponding counter. Since the step motors 25*a* to 25*i* are designed to rotate by a constant angle per drive pulse, the counts of the counters 30*a* to 30*i* represent the rotational angles of both the step motors 25*a* to 25*i* and the reels 8*a* to 8*i* relative to the respective reference positions. Since the reels 8*a* to 8*i* each individually have predetermined kinds of symbols in a predetermined sequence relative to the reference position, it is possible to determine by the counts of the associated counters 30*a* to 30*i* what kinds of symbols are displayed in the respective display windows 5 when the reels 8*a* to 8*i* stop.

Accordingly, when all the step motors 25*a* to 25*i* stop, the counts of the counters 30*a* to 30*i* are read into the CPU 20 to determine what kinds of symbols are displayed in the display windows 5. Then, the CPU 20 determines with reference to a hit combination memory 32 as to whether there is any hit combination in any of the effective winning lines. The hit combination memory 32 stores the predetermined hit combinations of three symbols in form of combinations of three numerical values corresponding to possible counts of the counters 30*a* to 30*i* along with the number of tokens to be paid for each hit combination. Thus, the CPU 20, the counters 30*a* to 30*i*, and the hit combination memory 32 constitute a game result determination device. If the game result determination device determines that a hit combination is carried off, a pay out device 33 pays out tokens of the number predetermined in accordance with the rank of the hit combination.

According to the present invention, a triumphal rotation data memory 35 is provided in the slot machine. The triumphal rotation data memory 35 stores data for driving some of the step motors 25*a* to 25*i* so as to rotate corresponding reels in a special fashion which remarkably differs from the above-described ordinary rotations of the reels 8*a* to 8*i*, additionally after the step motors 25*a* to 25*i* and the reels 8*a* to 8*i* once have stopped.

The CPU 20 refers to the triumphal rotation data memory 35 when a predetermined big hit combination is displayed on the effective winning line as a result of a game, and controls the motor controller 24 in accordance with the data of the triumphal rotation data memory 35, to rotate only those reels which display the symbols of the predetermined big hit combination. Accordingly, the CPU 20, the triumphal rotation data memory 35 and the motor control circuit 24 constitute a secondary drive device of the step motors 25*a* to 25*i* for the triumphal rotation of the reels 8.

According to an embodiment of the triumphal rotation, the reels concerned with the displayed big hit combination are rotated alternately in reverse and normal directions though a limited angle as set forth in detail below. Of course, the data of the triumphal rotation data memory 35 may be revised to change the pattern of the triumphal rotation.

Figure 4:
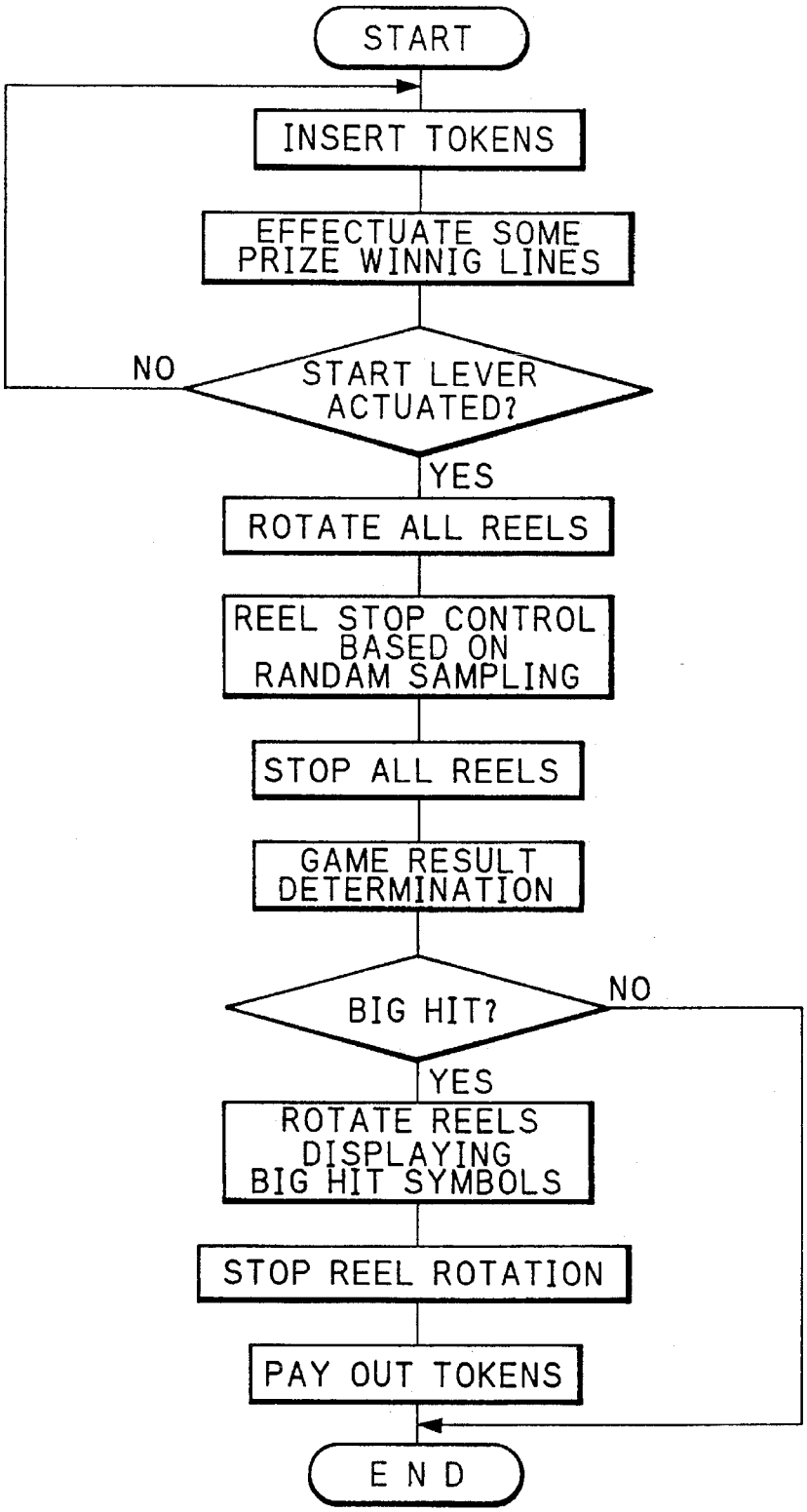
FIG. 4 is a flow chart illustrating the operation of the slot machine.

The operation of the above-described slot machine will be described with reference to FIGS. 4 and 5A. When one or more tokens are inserted in the slot 10, the number of inserted tokens is detected by the token sensor 21. The CPU 20 effectuates some of the winning lines 6*a* to 6*d* in accordance with the number of inserted tokens, and indicates the effective winning lines by the associated arrow marks 13.

When the start lever 11 is operated to cause the start signal generator 23 to output a start signal to the CPU 20, the CPU 20 outputs a drive start signal to the motor control circuit 24 to actuate the nine step motors 25*a* to 25*i* to start rotating the reels 8a to 8*i* simultaneously. In early stage of the motor actuation, pulse spacings of the drive pulses are gradually reduced from a wider value so as to gradually accelerate the step motors 25*a* to 25*i* up to a predetermined constant speed, as is shown in FIG. 5A. In this way, the step motors 25*a* to 25*i* and the reels 8*a* to 8*i* smoothly start rotating in spite of their inertia.

The pattern of drive pulses is previously stored in the ROM 28. In the timing charts of FIG. 5A, positive drive pulses cause the normal rotation of the step motors 25*a* to 25*i*, whereas negative drive pulses cause the reverse rotation. The reel rotation curve on the positive side represents the speed of normal rotation of the reels 8*a* to 8*i*, whereas the curve on the negative side represents the speed of reverse rotation of the reels 8*a* to 8*i*, and the center line represents a stop or pause of the reels 8*a* to 8*i*.

Figure 5A:
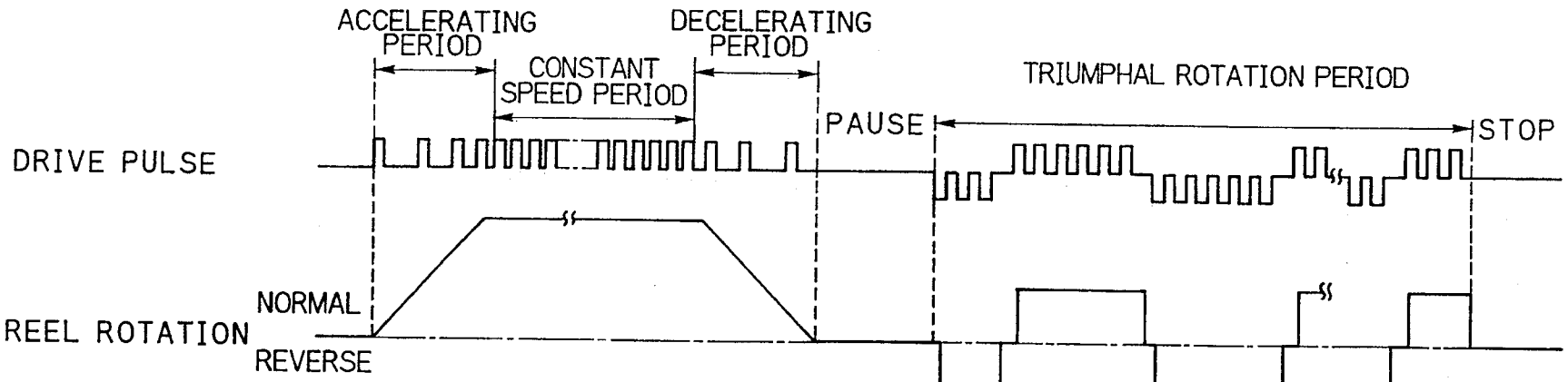
FIG. 5A shows timing charts illustrating a reel drive pattern for the triumphal rotation.

After being thus accelerated, the reels 8*a* to 8*i* come to rotate at a constant speed in the normal direction with the drive pulses having constant pulse spacings, as shown in FIG. 5A. Then, the sampling circuit 27 starts sampling random numbers one after another from the random number generator 26. Data of the sampled random number is inputted into the CPU 20 to sequentially send a stop signal per one random number to the motor control circuit 24. The motor control circuit 24 stops the step motors 25*a* to 25*i* in accordance with the random numbers assigned thereto. When stopping the step motors 25*a* to 25*i*, the pulse spacings of the drive pulses are gradually enlarged to decelerate the step motors 25*a* to 25*i*, as is shown in FIG. 5A. In this way, the reels 8*a* to 8*i* are smoothly put into stop in spite of their inertia.

As soon as all the reels 8 have stopped, the CPU 20 reads the counts of the respective counters 30*a* to 30*i*, and refers to the hit combination memory 32 to determine the game result depending upon the counts of the counters 30*a* to 30*i*. For example, when the reels 8*a* to 8*i* stop in positions as shown in FIG. 2 in result of a game started with three tokens, where a big hit combination "7"- "7"- "7" is displayed in the diagonal up-to-the right winning line 6*d*, the CPU 20 determines that the game resulted in a big hit game.

When the big hit is carried off, the CPU 20 once turns all the LEDs 14 off, and then causes only those LEDs 14 to flash cyclically on and off which are disposed behind the arrow marks 13 indicating the winning line 6*d* on which the big hit combination appears. Simultaneously, the CPU 20 reads the triumphal rotation data from the memory 35 and sends it to the motor controller 24. In accordance with the data, the three step motors 25*c*, 25*e* and 25*g*, which are coupled to the three reels 8*c*, 8*e* and 8*g* displaying the symbols "7" in the line 6*d*, are each supplied with a new series of drive pulses having a pulse pattern as shown in the last stage of the timing chart of FIG. 5A.

Thus, as shown for instance with respect to the reel 8*e* in FIG. 2, only the three reels 8*c*, 8*e* and 8*g* are additionally rotated first in the reverse direction by a rotational amount P corresponding to three negative drive pulses. In this embodiment, the amount P is approximately equal a half length of each symbol in the circumferential direction of the reels 8*a* to 8*i*. However, the amount P and the corresponding number of the drive pulses may be appropriately determined by revising the triumphal rotation data memory 35. The following six positive drive pulses cause the reels 8*c*, 8*e* and 8*g* to rotate by an amount 2P in the normal direction, and subsequent six negative drive pulses cause the three reels 8*c*, 8*e* and 8*g* to rotate by the amount 2P in the reverse direction.

In this way, each of the three reels 8*c*, 8*e* and 8*g* are rotated alternately in the normal and reverse directions through the limited angle corresponding to the amount 2P. In other words, the symbols "7" of the reels 8*c*, 8*e* and 8*g* vibrate in the display windows 5 in opposite directions at the amplitude P from the center of the windows 5 at the amplitude P. After several cycles of such vibration, e.g. five cycles of vibration, the reels 8*c*, 8*e* and 8*g* are finally rotated by the amount P in the normal direction to stop with the symbols "7" located at the initial center position. Upon finishing the triumphal rotation, the CPU 20 actuates the pay out device 33 to discharge a great number of tokens predetermined for the big hit.

According to the above-described embodiment, since the player can observe big hit symbols vibrating in the display windows 5 throughout the triumphal rotation, the corresponding reels, i.e. 8*c*, 8*e* and 8*g* in this instance, may be caused to start the triumphal rotation as soon as all the reels 8*a* to 8*i* once have stopped in response to the stop signals.

Figure 5B:
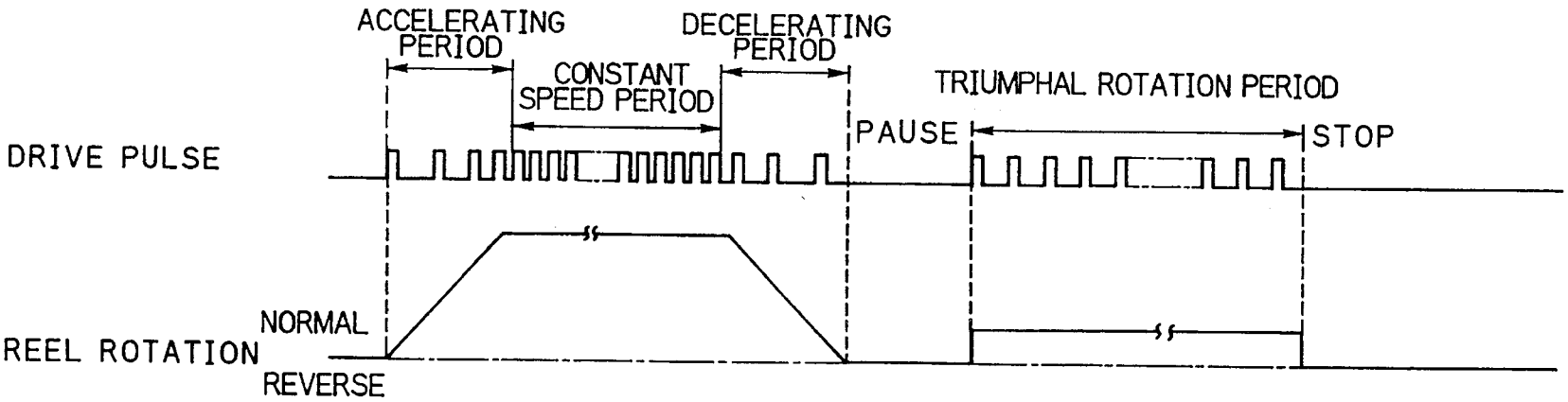
FIG. 5B shows timing charts illustrating another reel drive pattern for another kind of triumphal rotation.

FIG. 5B shows another pattern of the triumphal rotation, wherein the reels that pause with big hit symbols on the effective winning line are rotated once again to make a 360° revolution at a remarkably lower speed than usual. The lower speed preferably has a value that permits the player to distinguish the viewed symbols from one another through the display windows 5. Although the shown embodiment relates to a case where the reel makes the 360° triumphal rotation in the normal direction, it is, of course, possible to make the 360° triumphal rotation in the reverse direction.

As described so far, the slot machine according to the present invention can make an appeal to the player at the occurrence of the big hit in a novel fashion that the reels displaying the big hit symbols are rotated in a special pattern. This is a unique triumphal performance which effectively increase the player's satisfaction without the need for any complicated mechanism or system. Of course, the triumphal rotation of the invention may be combined with other visual or acoustic triumphal performance like the above described splendid lighting or fanfare.

Also, thanks to the triumphal rotation of the present invention, even an inexperienced player can be aware of the obtained hit combination at a glance in the nine-reel type slot machine having a lot of winning lines.

Although the above-described embodiment make the triumphal rotation only when the big hit occurs, it is possible to perform the triumphal rotation for every kind of wins in a pattern specific to each rank. The present invention is preferably applicable to those slot machine where the number of tokens to be paid out as a prize is counted up until the player request a discharge of the accumulated number of tokens.

Moreover, as disclosed in the above-mentioned U.S. patent application, it is possible in the matrix reel type slot machine to provide a win which is given when the same symbols appear on the four corner reels 8*a*, 8*c*, 8*g* and 8*i*, when the same symbols appear on more than one winning line, e.g. in the shape of a cross in the nine reel type, as well as when a special symbol appears on any one of the nine reels 8*a* to 8*i*. At these unique wins, rotating the concerned reel or reels in a special fashion is most preferable because it shows which symbols constitute the win, while attracting the player's attention to the slot machine.

The present invention is applicable not only to nine-reel type slot machines, but any type slot machines, to say nothing of the first described three or five-reel type slot machines, wherein all the reels are caused to vibrate or make another pattern triumphal rotation when a predetermined win appears on any effective winning line. In the three or five-reel type slot machine, a single winning line across the center of the display windows may be possible.

Also, the present invention is applicable to a slot machine which is incorporated in a pinball machine. The present invention is further applicable to a slot machine which has inner and outer coaxial overlying reels, as disclosed U.S. Pat. No. 5,395,111. The outer reels have transparent outer circumferential frame to allow a player to see symbols on the inner reels.

Thus, the present invention is not limited by the embodiments shown in the drawings but, on the contrary, various modifications, changes, combinations and the like of the present invention can be effected without departing from the spirit and scope of the invention as defined by the appended claims.

What is claimed is:

1. In a slot machine comprising:

a plurality of display windows;

a plurality of reels mounted rotatable each behind a respective one of said display windows, said plurality of reels each having a series of symbols affixed on an outer circumference of each of said plurality of reels;

a plurality of motors each assigned for rotating a respective one of said plurality of reels;

a first motor drive device which starts driving said plurality of motors in response to a start signal, and stops driving said plurality of motors in accordance with stop signals sequentially generated for respective ones of said plurality of motors;

at least a winning line extending across said plurality of display windows; and a game result determining device for determining if any winning symbol combination appears on any of said at least a winning line when all of said plurality of reels get stopped in accordance with said stop signals;

the improvement comprising:

a second motor drive device for driving at least a part of said plurality of motors in a special fashion, said at least a part of said motors corresponding to those ones of said plurality of reels which stop with symbols constituting said any winning symbol combination.

2. A slot machine according to claim 1, wherein said second drive device is adopted to rotate said ones of said plurality of reels alternately in normal and reverse directions within a limited angular range corresponding to a length of each of said series of symbols.

3. A slot machine according to claim 1, wherein said second drive device is adopted to rotate said ones of said plurality of reels through an angle of 360° at a low speed from the respective stop positions provided by said first device.

4. A slot machine according to claim 1, wherein said plurality of display window are arranged in an M×N matrix, each of M and N being 2 or more.

5. A slot machine according to claim 4, wherein said at least a winning line includes a plurality of winning lines extending across centers of said display windows along row lines, column lines, and diagonal lines of said M×N matrix, and one symbol of each of said series of symbols is placed at the center of each of said display windows when said plurality of reels stop.

6. A slot machine according to claim 5, further comprising a counter for counting coins or tokens inserted in said slot machine for a game, wherein a variable number of said plurality of winning lines are effectuated in accordance with the number of inserted coins or tokens.

7. A slot machine according to claim 1, wherein said first motor drive device comprises a start signal generator for generating said start signal upon actuation of a manual operation member, a random number generator, a sampling circuit sampling a random number as one of said stop signals, and a motor control circuit for driving said plurality of motors, whereas said second motor drive device comprises said motor control circuit and a memory storing data of driving said motors in said special fashion.

8. A slot machine comprising:

a plurality of display windows;

a plurality of reels mounted rotatable each behind a respective one of said display windows, said plurality of reels each having a series of symbols affixed on an outer circumference of each of said plurality of reels;

a plurality of motors each arranged for rotating a respective one of said plurality of reels;

a first motor drive device which starts driving said plurality of motors in response to a start signal, and stops driving said plurality of motors in accordance with stop signals sequentially generated for respective ones of said plurality of motors, such that one whole symbol of each of said series of symbols is placed in each of said display windows when said plurality of reels stop;

a game result determining device for determining if a special win is provided by at least a special symbol displayed on at least one of said plurality of reels when all of said plurality of reels get stopped in accordance with said stop signals; and a second drive device for driving at least one of said plurality of motors in a special fashion, said at least one motor corresponding to said at least one reel which displays said at least a special symbol providing said special win.

9. A slot machine according to claim 8, wherein said second drive device is adopted to rotate said at least one of said plurality of reels alternately in normal and reverse directions within a limited angular range corresponding to a length of each of said series of symbols, around the stop position provided by said first drive device.

10. A slot machine according to claim 8, wherein said second drive device is adopted to rotate said at least one of said plurality of reels through an angle of 360° at a low speed from the stop position provided by said first drive device.

11. A slot machine according to claim 8, wherein said plurality of display windows are arranged in an M×N matrix, each of M and N being 2 or more.

12. A control method for a slot machine comprising a plurality of display windows, a plurality of reels mounted rotatable each behind one of said display windows, said plurality of reels each having a series of symbols affixed on an outer circumference of each of said plurality of reels, a plurality of motors each arranged for rotating a respective one of said plurality of reels, said method comprising the steps of:

A. starting driving said plurality of motors in response to a start signal;

B. sequentially generating stop signals for respective ones of said plurality of motors;

C. stopping driving said plurality of motors in accordance with said stop signals, to stop said plurality of reels each with one of said series of symbols placed in a center of each of said display windows;

D. determining if any win is provided by any symbol displayed on at least one of said plurality of reels when all of said plurality of reels stop in accordance with said stop signals; and E. when it is determined in step D that a win is provided, driving at least one of said plurality of motors in a special fashion, said at least one motor corresponding to said at least one reel which displays a symbol constituting said win.

13. A method according to claim 12, wherein step E comprises the step of rotating said at least one reel alternately in normal and reverse directions within a limited angular range corresponding to a length of each of said series of symbols, around the stop position provided in step C.

14. A method according to claim 12, wherein step E comprises the step of rotating said at least one reel through an angle of 360° at a low speed from the stop position provided in step C.

15. A method according to claim 12, wherein one of said any win is provided by a predetermined symbol.

16. A method according to claim 12, wherein one of said any win is provided by a predetermined combination of symbols aligned in a line.

17. A method according to claim 12, wherein said plurality of display windows are arranged in an M×N matrix, each of M and N being 2 or more.

18. A method according to claim 17, wherein one of said any win is provided by a predetermined combination of symbols displayed on four corners of said M×N matrix.

* * * * *